US005704403A

United States Patent [19]

Schwenk et al.

[11] Patent Number: 5,704,403

[45] Date of Patent: Jan. 6, 1998

[54] DEVICE FOR REFILLING A PRINTER CARTRIDGE OF AN INK JET PRINTER

[75] Inventors: Peter Schwenk, Schenkenzell; Christoph Henzler, Lauterbach; Hans-Juergen Harp, Hanover, all of Germany

[73] Assignee: PMS GmbH Produktion + Recycling Von Buromaschinenzubehor, Germany

[21] Appl. No.: 557,742

[22] Filed: Nov. 13, 1995

[30] Foreign Application Priority Data

Nov. 12, 1994 [DE] Germany ..... 44 40 561.8

[51] Int. Cl.[6] ..... B65B 1/04

[52] U.S. Cl. ..... 141/18; 141/116; 141/325; 141/369; 141/198; 347/85

[58] Field of Search ..... 141/2, 18, 20.5, 141/21, 97, 115, 116, 121–123, 325, 367, 369, 370, 375, 378, 379, 198, 95; 347/85, 87

[56] References Cited

U.S. PATENT DOCUMENTS

| | | | |
|---|---|---|---|
| 4,967,207 | 10/1990 | Ruder | 347/87 |
| 4,990,938 | 2/1991 | Brandon et al. | 347/87 |
| 5,367,328 | 11/1994 | Erickson | 347/85 |
| 5,561,450 | 10/1996 | Brewster, Jr. et al. | 347/87 |

*Primary Examiner*—Henry J. Recla
*Assistant Examiner*—Steven O. Douglas
*Attorney, Agent, or Firm*—Stein, Pendorf & Van Der Wall

[57] ABSTRACT

Device for the refilling of a print head of an ink jet printer outside of the ink jet printer, with a holder, into which the print head can be inserted, wherein the print head includes an ink supply chamber, which is in fluid communication with the emission opening of a nozzle plate and which is vented through a ventilation opening, with an ink tank, which by means of a conduit and a coupling piece is capable of forming a fluid connection with a fluid tight sealing engagement with the ventilation opening, a receptacle container, which via a conduit and a coupling piece is sealingly engageable with the nozzle plate for establishing a fluid communication with a fluid tight seal, a pump with a reversible conveyancing direction, which is provided between the ink tank and the ventilation opening, control electronics, which works upon the pump in such a manner, that the ink is conveyed from the ink tank to the ink supply chamber so long, until the desired fill condition is achieved and subsequently the supply direction of the pump is reversed, so that the supply pressure is reduced and, where desired, a predetermined under pressurization can be established in the ink supply chamber, as well as a design of the holder in such a manner, that the print head is positionable in the holder with an essentially upwards directed nozzle plate (refill position).

29 Claims, 6 Drawing Sheets

DEVICE FOR REFILLING A PRINTER CARTRIDGE OF AN INK JET PRINTER

BACKGROUND OF THE INVENTION

1. Field of the Invention

The invention concerns a device for the refilling of a print head of an ink jet printer according to the preamble of claim 1.

2. Description of the Related Art

Now as before the majority of the print heads sold commercially for ink jet printers are conceived as one-way products, which must be discarded after the depletion of the ink supply. This is undesirable for ecological and economic reasons, since the depleted print heads are substantially completely functional and besides this include a number of valuable components such as, for example, the nozzle plate through which the ink is ejected, or the contact ribbon which carries the electrical signals for controlling the discharge of the ink.

Accordingly, proposals have already been made for refilling the printer heads using appropriate measures and therewith to prolong the useful life. In the simplest case, the printer head can be refilled by hand using a bellows-like refill container, as is known, for example, from WO 92/20 577. For this purpose the refill container includes a hollow needle, which is inserted into the housing of the printer head through a ventilation opening and is thusly inserted into the ink supply chamber. By pressure of the bellows-like, elastic deformable section of the refill container the ink located therein is pumped into the print head ink supply chamber.

Although the refill container as described above is suitable in principal to refill printer heads, a number of practical handling problems do occur in practice. So it is, for example, not to be prevented, that during the refilling process ink runs out of the nozzle plate, this being associated with a danger of soiling.

For the circumvention of this problem and for general simplification of the refill process it has also already been proposed, for example, to provide a refill station, as it is known for example from the previously applied for, however, subsequently published, patent DE 43 27 178 C1. These devices are comprised of a holder with a sealing means, into which the print head to be refilled is introduced and appropriately positioned. Hereby the nozzle plate situated at the bottom side of the printer head as well as the, as the case may be, adjacent located ventilation opening are brought into sealing engagement against the sealing means. Subsequently a canula carrier which is provided with a canula is seated on the thus seated printer head or, in certain cases, on the holder, so that the canula penetrates through a refill bore hole of the printer head into the ink supply chamber. A refill cartridge which is seatable upon the canula empties itself into the print head ink supply chamber after the removal of a sealing cap, so that the refill process runs by itself without any further intervention. An unintentional emanation of ink from the nozzle plate and the ventilation opening is substantially prevented by the use of the diverse sealing means.

Although this type of refill station has at least in part simplified the refilling of printer heads, there remains however now as before the requirement to carry out process steps, which must be carried out manually. In particular there are included therein the introduction of the canula in the inside of the ink supply chamber, or the seating or, as the case may be, the removal of the refill cartridge. Further, it is necessary with these refill stations that, through the employment of suitable construction measures, the diverse openings are sealed off in a particular sequence and after the refilling are again opened, so that also with printer head type of a bellows-type under pressure system the ink flows into the ink supply chamber out of the seated refill cartridge under atmospheric pressure is made possible.

There are also known devices of the type with the help of which the refill process can be run automatically at least in part, for example, those as known from EP 0 603 910 A1, over which the present invention represents an improvement. This is comprised of a mounting means, into which the printer head to be refilled is seatable. The ink supply is found in an ink tank, which via a conduit and a coupling piece can be sealingly engaged with the ventilation opening of the printer head. Further, the device contains a pump, and this in the form of a double-acting piston pump, which is at the one end connected to the ink tank and serves therefore, that the ink from the ink tank is delivered to the ink supply chamber of the printer head. On the other end the pump is, via a further channel and a coupling piece, connected to the nozzle plate of the printer head in sealing engagement, so that an underpressurization can be induced in the area of the nozzle plate and therewith in the inside of the ink supply chamber of the printhead. The double acting of the piston pump accomplishes, that with a displacement of the piston to the one side an overpressurization is produced, and the ink is conveyed out of the ink tank and into the ink supply chamber of the printhead. At the same time the opposing side of the piston produces an underpressurization, which partially evacuates the ink supply chamber. A series of valves insures, that the return movement of the piston occurs substantially without resistance, without any reversal of the pressure relationships.

Further valves can be provided as desired at various positions, so that the relation and the timely movement of the partial vacuum of the ink supply chamber on the one hand and the conveying pressure to the supplying ink on the other hand is varied and is optimally adjusted to the previously described relationship. In the various variations there is however the unifying main principal, that at least in the beginning phase the refill process induces a partial vacuum in the ink supply chamber, so that the introduction speed of the ink, and therewith the speed of the refill process as such, is accelerated. This is of substantial importance with the therein described printer heads, since the ink supply chamber is filed with an open-poured sponge material as the receiving medium for the ink, which substantially slows down the penetration speed of the ink under normal pressure conditions. Through an at least partial reduction of the pressure in the ink supply chamber this problem is minimized.

An analogous solution, even though involving a different means of realization, can be found in EP 0 509 687 A2. Also in this case a vacuum is induced in the ink supply chamber, in order to encourage the introduction of ink. Additionally, however, in connection with the actual refill process, an underpressurization is formed via an adjacent to the nozzle plate situated suction opening, in order to "prime" the printer head. Therewith a suction process is carried out, which accomplishes, that the ink is sucked out of the receiving medium, for example the open-poured sponge material, for such a period, until the constructive determined intermediate space between the receiving medium and the nozzle plate is completely filled with ink. The print head is only ready for use when the ink has advanced to the nozzle plate and when there are no more air voids to be found in this intermediate area.

Although the above described devices make possible at least in part a simplification of the refill process, it is however still necessary for a service person to carry out actual manual manipulations. In the case of the first described device the pump must be operated by means of a hand lever, and it is also necessary, to observe the refill process, and to end it manually, as soon as overflowing ink exits out of the receiving container. This applies also in a sense for the devices known EP 0 509 687 A2, which explicitly requires a manual closing of the valves from a service person.

A further substantial disadvantage of the devices is comprised of the high construction costs, in order to especially establish and control the (partial-) vacuum.

The invention is thus concerned with the problem, to further develop a device of the type described in the above introductory section, which makes it possible for the consumer to directly refill the print head removed from the printer and to do this substantially without manual intervention, that is, a device with which the process which can be accomplished automatically. At the same time the device should be constructed simply and economically in order that it becomes more attractive for employment in the realm of the household or in small businesses.

SUMMARY OF THE INVENTION

The problem is solved by a device for the refilling of a print head of an ink jet printer outside of the ink jet printer, with a holder, into which the print head can be inserted, wherein the print head includes an ink supply chamber, which is in fluid communication with the emission opening of a nozzle plate and which is vented through a ventilation opening, with

- an ink tank, which by means of a conduit and a coupling piece is capable of forming a fluid connection with a fluid tight sealing engagement with the ventilation opening,
- a receptacle container, which via a conduit and a coupling piece is sealingly engageable with the nozzle plate for establishing a fluid communication with a fluid tight seal,
- a pump with a reversible conveyancing direction, which is provided between the ink tank and the ventilation opening,
- control electronics, which works upon the pump in such a manner, that the ink is conveyed from the ink tank to the ink supply chamber so long, until the desired fill condition is achieved and subsequently the supply direction of the pump is reversed, so that the supply pressure is reduced and, where desired, a predetermined under pressurization can be established in the ink supply chamber, as well as
- a design of the holder in such a manner, that the print head is positionable in the holder with an essentially upwards directed nozzle plate (refill position).

The invention is based on the idea, that the ink is pumped through an opening which is originally constructed as a ventilation opening or as the case may be ventilation spire into the ink supply chamber of the printer head under high pressure and thereby permits displaced air to be evacuated through the exit opening of the nozzle plate. At the same time, the holder for the printer head is so constructed, that the printer head is positionable with the nozzle plate substantially facing upwards. The air which is displaced by the forced introduction of ink can thus escape towards upwards, so that formation of foaming or blisters is precluded even at high ink introduction rates under high pressure. The displaced air can, without hindrance, be forced out through the exit opening of the nozzle plate which is situated above the ink level, since the air is situated above the ink level. The maximal fill level is accomplished when the ink level reaches the exit opening of the nozzle plate. Through the positioning of the nozzle plate by orienting it upwards it is insured, that the ink supply chamber is in this condition completely filled and the print head is therewith renewed with practically the entire volume reused.

With this configuration the refill device can be realized with comparatively small construction expenditure, since the requirement for the evacuation of the ink supply chamber can be completely omitted. There is also in no way any associated disadvantage in functionality, since the process can be carried with a comparatively high introductory pressure. Further, the air which is displaced out through the exit opening of the nozzle plate insures for a desired cleaning effect in the area of the nozzle plate, since the air flow which exits with high velocity carries along with it paper dust, which may have attached itself in the area of the exit opening. Therewith it is reliably insured against, that the dust particles penetrate into an plug up the entry opening, which may occur in the conceivable alternatives, in which the ink is resupplied by introduction through the nozzle plate.

The employment of the ventilation opening or as the case may be the ventilation spire as a introduction opening for the ink is advantageous, for various reasons, not the least of which is that it is accessible from the outside of the housing of the printer head without complication. Preliminary steps for the exposing of the, as the case may be, available refill openings, such as for example the depressing of a ball which serves as a closure element, is unnecessary in the present case.

A further substantial advantage as comprised therein, that the print head is capable of use immediately after the refilling. A subsequent preparation step in the form of the above-described priming is not necessary, since as a result of the positioning print head during the refill process the space which eventually occurs between the receiving medium and the nozzle plate is, without further intervention, filled with ink and the air which is to be found within the space is displaced.

A further, substantial advantage of the device is comprised therein that the refill process can be accomplished completely automatically by means of a control electrics. In this case the ink is introduced into the ink supply chamber so long, until the desired fill condition is arrived at. Thereupon the supply direction of the pump is reversed, so that the delivery pressure is deconstructed and, as desired, a predetermined underpressurization is established in the ink supply chamber. The reduction of the delivery pressure by the reversal of the delivery direction accelerates the pressure equalization, so that practically immediately after reaching the desired fill condition the printer head can be removed from the holder, whereby no soiling danger remains from the residues of the ink supplied under delivery pressure.

The reversal of the supply direction makes it possible, to establish in the ink supply chamber a under pressurization as required for the given printer heads, is not or is established only reduced levels.

In the concrete realization of the idea there is thus an ink tank provided, which by means of a conduit and a coupling piece is in sealing communication with the ventilation opening, so that a fluid connection between the ink tank and the ink supply chamber can be established. Along this conduit a pump is provided with reversible delivery direction, which is completely automatically operatable in the desired means via the control electrics.

There is further provided a receiving container, which via a conduit and a coupling piece is in sealing engagement with the nozzle plate, so that ink droplets, which may be transported along with the air which exits out of the nozzle area during the refill process is intentionally collected and no danger of soiling exits. This type of ink drop attaches frequently to the nozzle plate itself or to the areas immediately adjacent thereto on the inside of the ink supply chamber on the wall areas, over which the displaced air passes, so that the droplets are unavoidably carried along with the air stream.

Therewith the ink supply chamber of the printer head is integrated in and sealed off during the time of the refill process in a closed conduit system, in which fluid streams are directed intentionally and which are fully automatically controlled, as well as at the same time any unintentional emission of ink is prevented. The device makes possible accordingly the automatic refilling of printer heads without manual intervention.

Further advantages are produced by the installing of a signal emitter in the conduit between the nozzle plate and the receiving container, which determines as soon ink is emitted out of the nozzle plate and in the conduit enters. This is the criteria for determining that the ink supply chamber of the printer head is completely filled up and therewith the pump can be turned off. For this purpose the signal emitter is connected to the control electronic, which acts upon the pump in the above described art and manner. It is understood that the signal emitter is constructed of the type, that it does not detect individual ink droplets which are carried along with the air stream, but rather gives a signal then, when the fluid passing through the space in the conduit is barely above the exit opening of the nozzle plate.

As an alternative to this a signal provider can be installed in the conduit between the ink tank and the refill opening, and this in the segment between the pump and the ventilation opening. It measures in the indicated position the pressure, which exists in the supply conduit for the ink in advance of the introduction in the print head. As a turnoff or as the case may be direction reversing criteria for the pump a step increase in the pressure is determined, which is detected as a consequence of the throttling effect of the exit opening of the nozzle plate as soon as the ink level reaches the nozzle plate. So the exit opening establishes as a result of its minimal cross-section for the ink a throttle position, which instantaneously presents a resistance to the further advancement of the fluid front of the climbing ink level. The therewith associated pressure jump is communicated against the direction of advancement of the ink quickly and is detected by the signal emitter. The signal emitter is connected to the control electronic, which acts upon the pump in the above-described matter. In comparison to the above-described fluid detector sensor this type of signal emitter is constructed of a comparatively simpler and economical pressure sensor.

In comparison to other alternatives, which for example are based upon a pre-determined supply amount or a pre-determined supply duration, this method permits determination of the exact fill condition, so that a required fill condition can be achieved exactly, and so that the printer head can be completely refilled, even those cases in which residual amounts of ink are present in the ink supply chamber prior to filling, without the danger that an overfilling occurs. Further, variations in the supply amount of the ink not possible, since the pump is turned off or, as the case may be, reversed, at the exact point in time in which the ink supply chamber is refilled to the desired fill level.

Preferably further sensors are provided, which serve for the monitoring and/or controlling of the refill process. There are envisioned for this the known fluid- or flow sensors, which can be integrated at various positions in the conduit. So there is for example a sensor of this type provided in the conduit between the ink tank and the pump, in order to monitor the ink flow. Therewith it can be insured, that no air is supplied to the ink supply chamber of the print head, insofar as the ink tank may be depleted. In a case of this type the control electronic insures therefore, that the pump is immediately turned off and the reverse of the supply direction is engaged. This is necessary, in order that with a not completely filled ink supply chamber of the print head it can be removed without any problem and introduced into the printer. It is preferred to include an associated indicator element, for example in the form of LED or LCD control, or that an acoustic signal b initiated, in order to draw attention to this operating condition.

Preferred as a fluid detector sensor is such a sensor which utilizes the electric conductivity of the employed inks. By means of a resistance measurement between measuring points it can be determined by the simplest means whether ink is present or not.

The same principal can be employed for the monitoring of the ink emission from the nozzle plate, whereby the two measuring points are situated in relatively close proximity to each other, in order that as small amount as possible of ink must be emitted. As already described above, this senor initiates a reverse in the direction of supply of the pump.

The signals measured by the sensors can at the same time be used therefore, in order to provide an indication of the respective operating condition. Preferably LEDs are employed which have various blinking frequencies or various colors for characterization or indication of diverse operating conditions. These can also be coupled to acoustic signals.

Further it is advantageous, when in the supply conduit, in particular in the segment between the pump and the ventilation opening, a further sensor is installed, which monitors the pressure of this segment. This is desirable, in order to prevent an undesirable pressure increase in the case of a plugging up of the ventilation opening or as the case may be ventilation spire, or as a result of plugging up of the exit opening of the nozzle plate area. A pressure increase of this type could on the one hand result in the damaging or disturbing of important construction elements or also may result in a strong soiling by the hammer-like spurt of ink at the moment of the breaking through of the clog. Also in this case a supply direction reversal of the pump must be accomplished and the operating condition must be indicated.

Particular advantages are produced when the conduit, in particular the conduit between the ink tank and the ventilation opening, is comprised of a flexible hose, in particular of silicon, polytetrafluoroethylene (PTPE) or polyethylene (PE). These simplify the (automatic) operation or manipulative steps, since the coupling and decoupling on the appropriate parts of the print head can be realized by a simple sliding of the respective end provided coupling pieces. Further this type of material opens up the possibility that is the pump there is employed the so-called hose pump, which in comparison to the other conventional pump types does not bring any type of dirt or friction particles into contact with the ink. This type of particle may in no case be introduced into the ink, since the functionality of the print head is compromised thereby.

Further these hoses offer the possibility of monitoring for the above-mentioned blockage conditions through clogging up of the exit opening and the like by monitoring the thickness of the hoses and/or the hose diameter. So in this case along with the occurrence of a pressure increase there is induced a broadening of the hose and this can be detected by simple means, such as optical sensors or the like. It is accordingly not necessary to install a sensor in the conduit itself, but rather this can be situated outside, that is, outside of the ink stream.

It is preferred that the coupling pieces provided at the ends of the conduits for the refill ventilation opening and for the nozzle plate are constructed as single pieces since, then, during the refilling of the print head type the ventilation opening and the nozzle plate are adjacent to each other. This is of special interest in the very widely employed version, in which the container floor is constructed stepwise, and the ventilation opening is provided as a ventilation spire in the returning segment. The sealing between the coupling piece and print head can be accomplished by a spring pressure of the returning section, so that by pressing of the coupling piece against the adjacent housing wall the transition from the conduit to the ventilation opening or as the case may be nozzle plate is in fluid tight engagement for the duration of the refill process.

Preferably the ink tank is comprised of a flexible material, namely a synthetic or plastic bag which is situated inside a form-stable housing. The housing can be constructed to be collapsible, so that the therein contained ink supply can be monitored without any problem. If at the same time principally the possibility exits, to refill the ink tank, it has been found to be advantageous, when this is designed to be reusable. So it is in the sense of an optimal and user friendly system to be seen, whereby in practice at various intervals the ink tank as such is replaced by a new one. Depending upon the respective pre-planned exchange interval, the volume of the ink tank can be designed to various levels. As a good compromise it has been determined, to select approximately a three-to-five-fold amount of the original print head (for example 120–200 ml), so that the ink tank and therewith the device is constructed optimally compact, and on the other hand, the change out interval is sufficiently long in the desired employment in the private realm or in small offices.

The ink tank must, in the remaining components, be so constructed, that it can receive during the reversing of the supply direction of the pump the returning ink or as the case may be ink-air mixture without problems.

The receiving container is preferably constructed at least in part of an absorbent material, preferably with felt, sponge or fleece, so that the ink droplets emitted from the area of the nozzle plate and the surge of ink overflow emitted at the end of the refill process is assuredly received. Only relatively small amounts are involved in this, and in a typical case approximately 1–2 ml ink waste per refilling process can be presumed to occur.

It is preferred that the receptacle container and/or the absorbent material can be changed out. For an essentially simplified manual step it is conceivable that the receptacle container inclusive of the therein contained absorbent material is completely changed out.

As it has been found to optimal that the ink tank and receptacle container are integrated into a common housing. This makes possible the conception of a user friendly device, since at the same time as the changing out of the spent ink tank also the receptacle container is changed out. Therewith the device be returned to the optimal starting condition with a single operating step.

As already discussed above, the nozzle plate must be directed upwards, in order that the emission of the displaced air is possible during the refill process. In the most cases the nozzle plate is positioned in a step-shaped segment so that the refilling process can only be carried out satisfactorily, when the print head is tilted relative to the vertical. In practice the orientation can be so selected so that, that the print head is positioned tilted with respect to the vertical at approximately up to maximal 80°.

In particular the device has been connived to be employable as a universal fill station, that is, for a variety of different print head types. It is advantageous that the print head receiving holder be detainable or arrestable in various selected angled positions. Respectively, according to the design, the optimal refill orientation can be established herewith. It is however a precondition that the holder be constructed to be pivotable.

For the reasons of improving manipulability the holder can be constructed to be pivotable in such a manner, that the print head can be introduced from above with the nozzle plate facing downwards, that is, in the position that the respective print head is itself employed in the printer, whereupon subsequent to the introduction the holder is pivoted to the refilled position.

Adaptors can be introduced into the holder, in order to make possible an adaptation to the various print heads. Also, the holder can be designed as the adaptor, insofar as this is constructed exchangeably. Therewith the device is suitable in particular for small offices, which make use of various printers or as the case may be print head types.

The concrete embodiment of the device is broadly variable. It is preferred that the individual construction elements are constructed according to a system of construction components so that it become possible to easily adapt the individual device to various demands. This applies also to the outer design, which can be broadly varied.

In technical respect it is desirable, that the device is integrated into a housing, which is sealable by means of a cover dome. The cover dome is coupled to the control electronics via a sensor in such a manner that an opening during the refill process is not possible, or on the other hand the refill process is immediately interrupted, insofar as the cover dome should be opened. Also further measures are possible, in order to, for example, prevent the beginning of the process, in the case that no print head is seated or another construction element is not in a necessary functional orientation.

With the above described concept, it is achieved, that a portable small refill station is realized with which failure conditions are practically eliminated. It cab also be so constructed, that it is made possible to store it during non-use in any possible position, without there being any emission of ink. This occurs substantially for the main reason that after conclusion of a refill process ink is conveyed out of the supply lines by reversal of the supply direction of the pump and returned to the ink and in particular with the employment of the hose pump which deforms the flexible conduit until any dripping out of the inevitably present ink is prevented.

BRIEF DESCRIPTION OF THE DRAWINGS

The invention is now described by reference to the illustrated embodiments as skeptically represented in the figures that are shown.

DETAILED DESCRIPTION OF THE INVENTION

Figure 1:
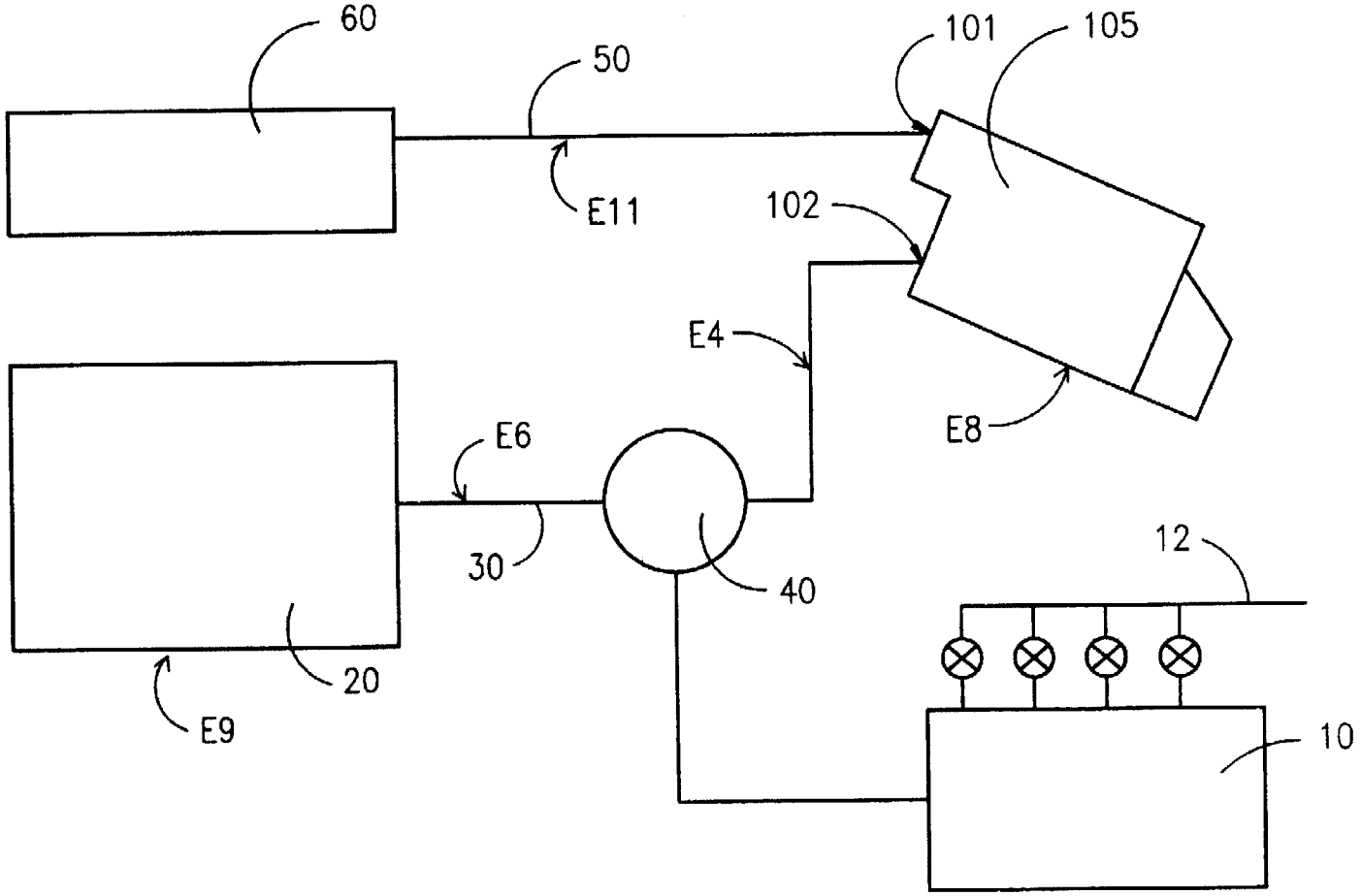
FIG. 1 control schematic of the device in a first embodiment.

In the device as shown in FIG. 1 it is concerned with a variation of that type in which the occurrence of ink in the conduit to an ink receptacle container is employed as the termination signal for the ending of the supply of the ink.

The print head 100 is introduced into a here not shown holder and this of the type, so that both the nozzle plate 101 and also the ventilation spire 102 are directed upwards. In relation to the vertical the print head 100 is pivoted approximately 70°. Sensor E8 adjacent to the print head 100 monitors whether the print head 100 is seated, and is connected to a control electronic 10 in a not shown manner and fashion. The control electronic 10 is comprised of a series of LEDs 12 which signal various operating conditions, of which one of the LEDs 12 indicates whether the print head 100 is seated.

An ink tank 20 is in communication with the ventilation spire 102 of the print head 100 by means of a hose conduit 30. The supply of ink is accomplished by means of a hose pump 40, which is, controlled by the control electronic 10. The sensor element E9 monitors, that the ink tank 20 is seated. Sensors E4, E6, serve for the monitoring of the ink flow in the conduit 30 and/or the monitoring of a unacceptably high pressure buildup in the ink supply space 105.

A receptacle container 60 is connected via a conduit 30 with the nozzle plate 101. A sensor E11 monitors the occurrence of ink in the conduit 30 or as the case may be the nozzle plate 101 and initiates the signal for the turning off or reversal of the pump 40.

Various construction elements are integrated in a here not shown housing.

Figure 2:
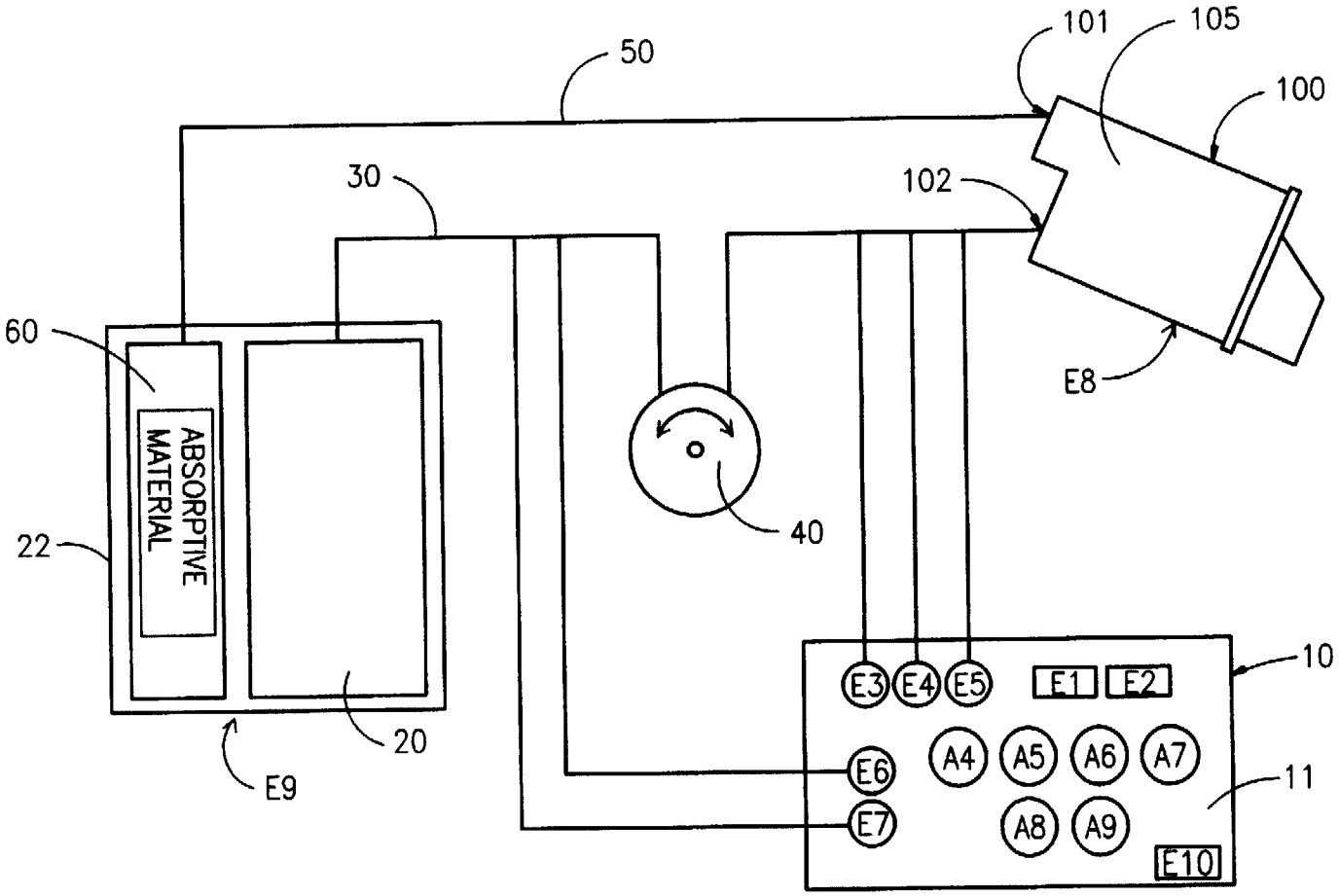
FIG. 2 control schematic of the device in a second embodiment.

The embodiment as shown in FIG. 2 employs as the turning off signal the step up of pressure in the supply conduit, which results as a consequence of the beginning of the above-described throttle effect of the nozzle plate. This variant has the advantage, that no ink need be emitted out of the nozzle plate, in order to initiate the turn off signal. In the remainder, the carrying out of the process is in correspondence with the remainder of FIG. 1, so that insofar as possible the same reference numbers are employed.

The print head 100 is again so seated, that both the nozzle plate 101 as well as also the refill spire 102 face upwards. The sensor E8 is with the control electronic 10 connected and monitored, whether the print head 100 is appropriately seated.

The control electronic 10 is comprised of LEDs, which signal various operating conditions, in particular whether the print head 100 is seated.

The ink tank 20 is connected via the hose conduit 30 with the ventilation spire 102 of the print head 100. The supply of ink is accomplished by means of a hose pump 40 which is controlled via control electronic 10. Sensor E9 monitors that the ink tank 20 is connected.

The receptacle container 60 is connected via a hose conduit 50 with the nozzle plate 101. Ink tank 20 and receptacle container 60 are integrated in a common housing.

The control electronic 10 is provided on a circuit board 11, which receives various monitoring organs as well as a series of operating elements.

As operating element 2, keys E1, E2 are provided, wherein the key E1 starts the filling process, in comparison to which the key E2 makes possible the controlling of a protective closure flap or, as the case may be, sealing dome, which is described in greater detail below.

For indication of varying operating and flow conditions indicators A4, A5, A6, A7, A8, A9 are provided, which can be constructed as LEDs 12 according to FIG. 1. Indicator element A4 indicates when the electrical supply is connected and the operating current is supplied. This condition is indicated by a blinking with a frequency of approximately 2 Hz. As soon as the print head is introduced properly and all other remaining, in a following further in further detail discussed starting conditions are satisfied, the indicator changes to a continuous light. Therewith it is signaled that the refill process can begin by depressing of a starting key E1.

The indicator element A5 signals that an opening of the protective flap or, as the case may be, the sealing dome, is now possible, for example, for introduction of or removal of the print head 100.

The indicator element A6 indicates that the refill process is running. During the duration of the refill process the indicator element A6 blinks with a frequency of approximately 2 Hz.

The indicator elements A4, A5, A6 signal the orderly running conditions and thus are maintained green.

The indicator element A7 is a warning signal which indicates that the ink supply in the ink tank 20 is depleted. It is designed to be in yellow and blinks with a frequency of 2 Hz.

The indicator element A8 indicates in the case that the print head 100 is plugged, for example, in the area of the nozzle plate 101. The indication is accomplished with a frequency of 2 Hz and is maintained in a red color.

The indicator element A9 is a general failure warning and provides an indication when the flow is to be avoided at a certain location.

Further there is provided on the mounting board 11 pressure switches E3, E4, E5, E6, E7, which are connected with the supply conduit 30 and control the refill process by acting as signal providers.

The refill switch E3 is activated as soon as the ink supply chamber 105 is filled with ink. It is thus designed to be of the type, that the pressure increase as described above as a consequence of the throttle effect of the nozzle plate 101 is detected.

The pressure switch E4 monitors whether the print head 100 is plugged up.

The pressure switch E5 monitors the reduction of the supply pressure following termination of the refill process.

The pressure switch E6 and E7 monitor the fill condition of the ink supply as found in the ink tank 20.

As to the sensors E3, E4, E5, E6, E7, these are of the type which are conceptualized as pressure switches and which thereby monitor the ink flow.

The sensors E8, E9 as well as further sensors E10, which control the below described protecting flap or, as the case may be, sealing dome, detect this and are provided as termination signals.

Figure 3:
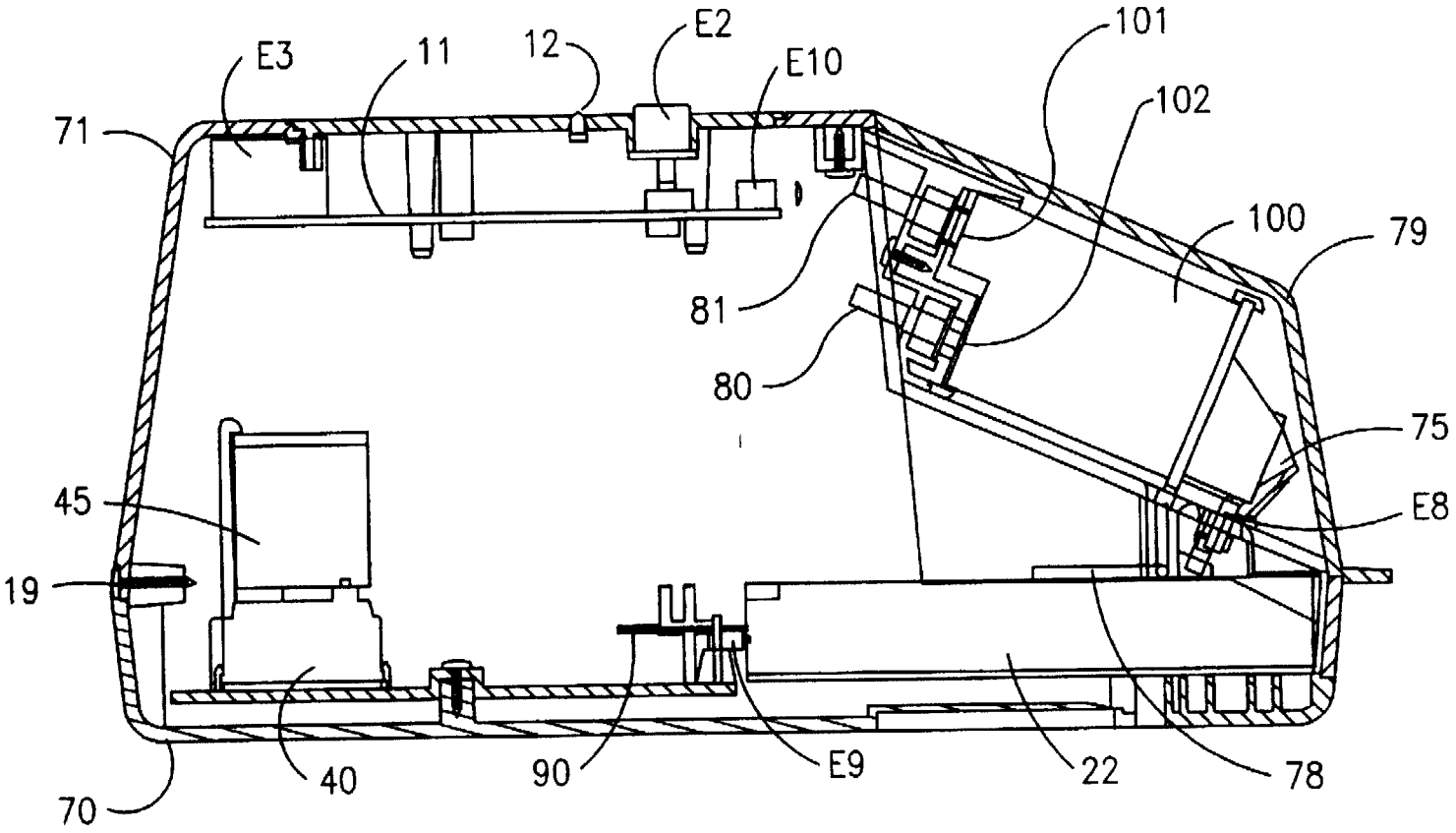
FIG. 3 device according to FIG. 2 in simplified cross-sectional representation.
Figure 4:
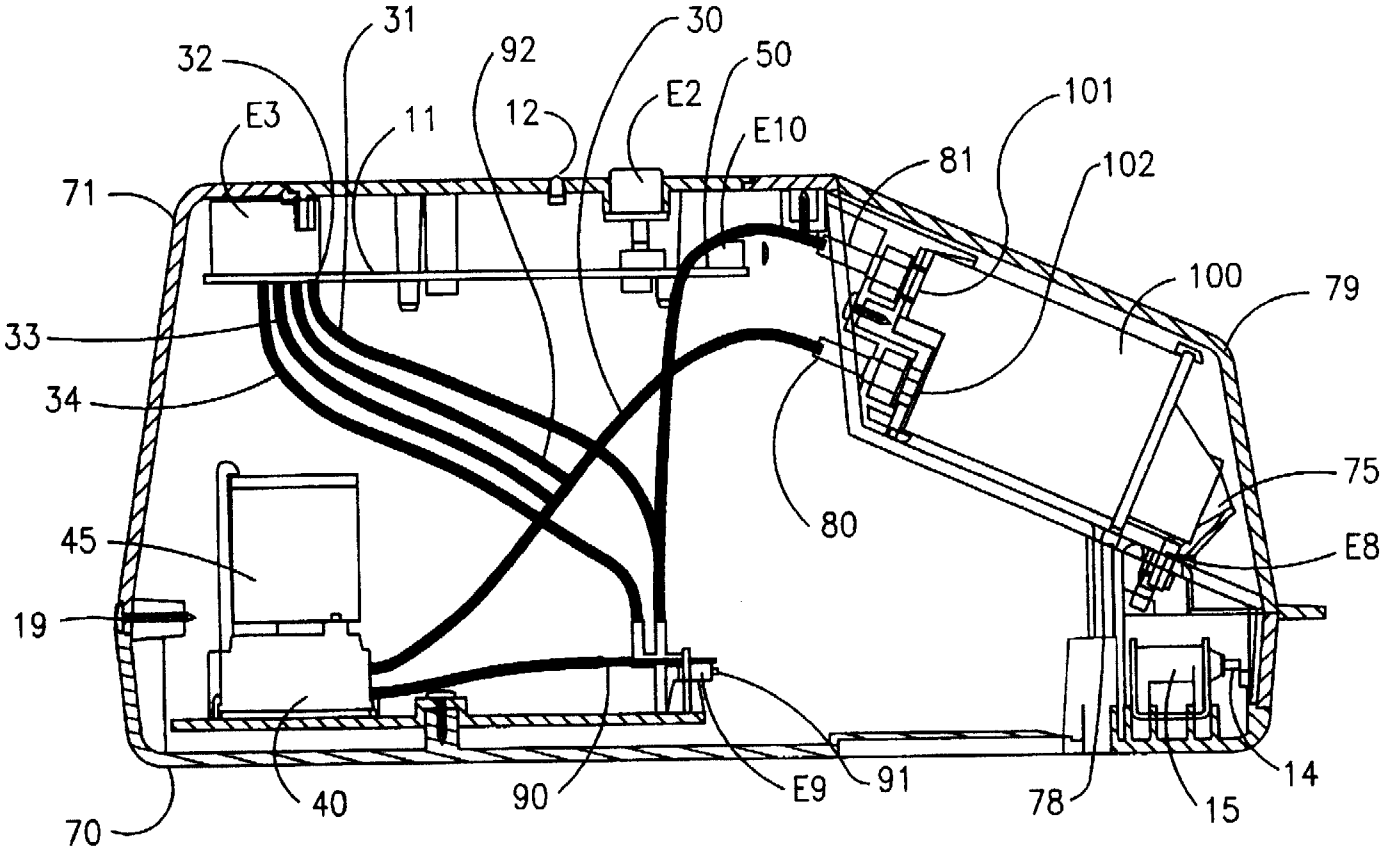
FIG. 4 device according to FIG. 2 in simplified sectional representation with hose connections included however without the ink tank.

The device as shown in FIGS. 3 and 4 show the concrete realization of the concept as shown in FIG. 2.

The cumulative device is provided within a two-part housing, which is comprised of a housing lower part 70 and a housing upper part 71, which parts receive the cumulative construction elements.

In the housing upper part 71 the circuit board 11 is mounted. In the desired plane or surface the keys E2 for opening of the protective flap 79, the pressure switch E3 for detecting of the termination signal, a light emitting diode 12 as well as the sensor element E10 for monitoring of the protective flap 79 are indicated. In order to better convey the overall inventive concept, the two figures do not include a representation of the electronic circuitry and wiring, since these are well known.

Underneath the protective flap 79 there is provided a mount 75, in which the print head 100 is introduced with an essentially upperly facing nozzle plate 101. The presence of the print head 100 is detected by sensor elements E8. The nozzle plate 101 and the ventilation opening 102 are sealed off and held under pressure by the mount 75 against the projecting support 81 and a refill support 84 for establishment of a sealed fluid connection between receptacle container 60 and ink tank 20.

Receptacle container 60 and ink tank 20 are positioned adjacent to each other in a common housing 22, which can be inserted into the housing part 70. The correct position of the housing 22 is monitored by sensor E9. Further, a double canula 91 is provided, which during the insertion of the housing 22 penetrates into the inside of the ink tank 20 and into the inside of the receptacle container 60 and establishes the desired fluid connection. For protection against injury by the canula 91 the housing lower part 70 and the area for introduction of the housing 22 are provided with a protective flap 78 and closed off, which as a result of the insertion of the housing 22 is tilted upwards and upon removal of the housing 22 is folded back down.

The fluid connection of the ink tank 20 to the ventilation opening 102 of the print head 100 is accomplished by means of a hose conduit 30, which via a hose splitter 90 is connected to the canula 91 and to the oppositely lying filling support 80. The hose conduit 30 is itself constructed as a continuous one piece conduit, since it supplies the ink by means of the hose pump 40, which attaches upon the hose conduit 30 in a known manner from the outside. The drive of the hose pump 40 is accomplished by means of the pump motor 45.

The conduit 30 is however interrupted by a hose distributor 92 in the segment between the hose pump 40 and the fill support 80, for making possible the detection of information concerning the pressure relationship at this segment via a sensor element, such as for example E3 or E4. For this there are employed hose conduits 30, 32, which are positioned between the hose distributor 92 and the sensor elements E3, E4.

The hose conduit 30 provides for the fluid connection between the nozzle plate 101 and the receptacle container 60. Further, hose conduits 33, 34 are provided, which likewise serve for the conveyance of pressure information and thus are connected at the one end to the hose distributor 90 and at the other end to the sensor element (E6, E7).

The housing lower segment 70 is further provided with a locking pin 14, which is operable by means of a control magnet 15. This serves for the safety closure control of the closure flap 79.

Figure 5A:
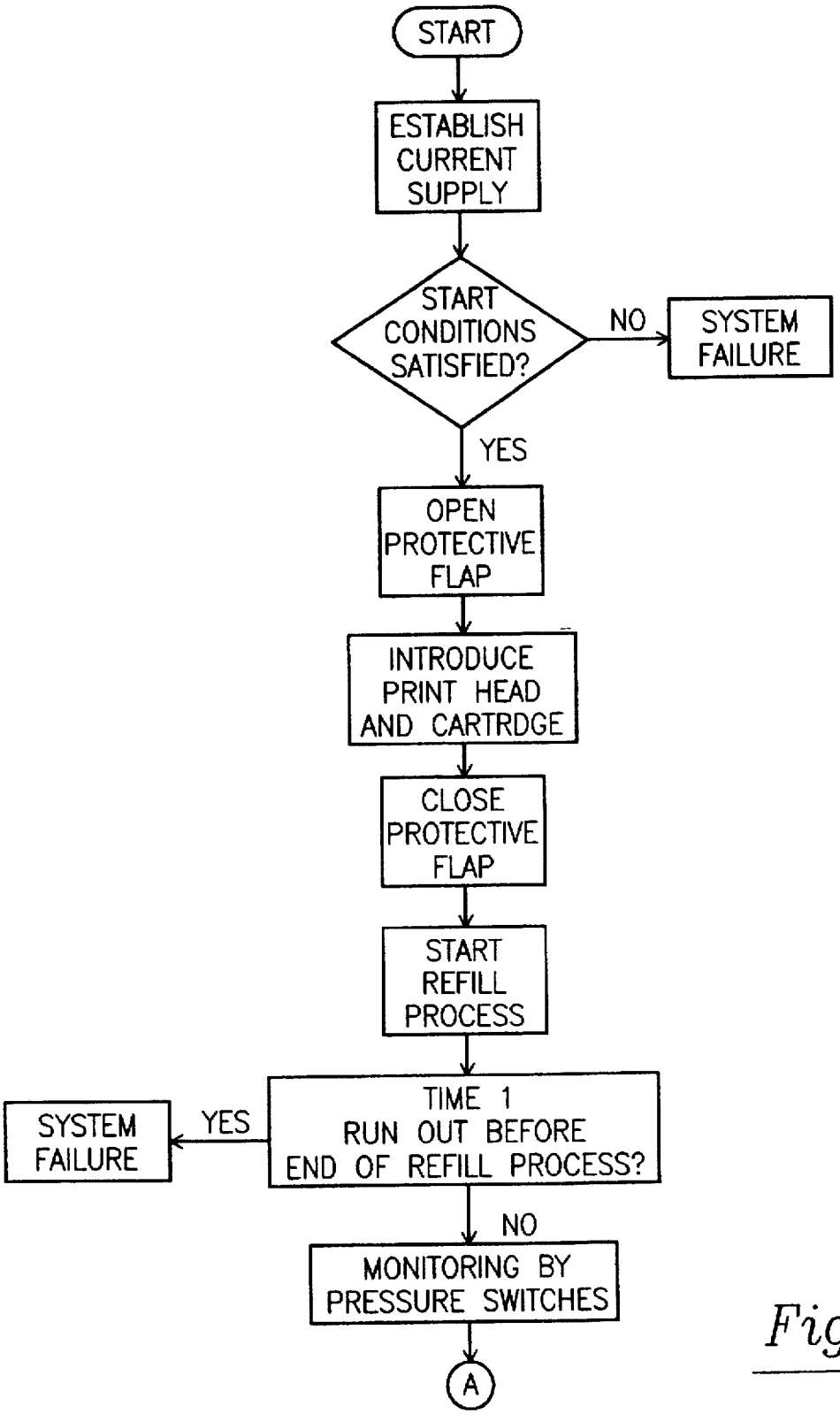
FIGS. 5*a*, 5*b* flow diagram of the control.
Figure 5B:
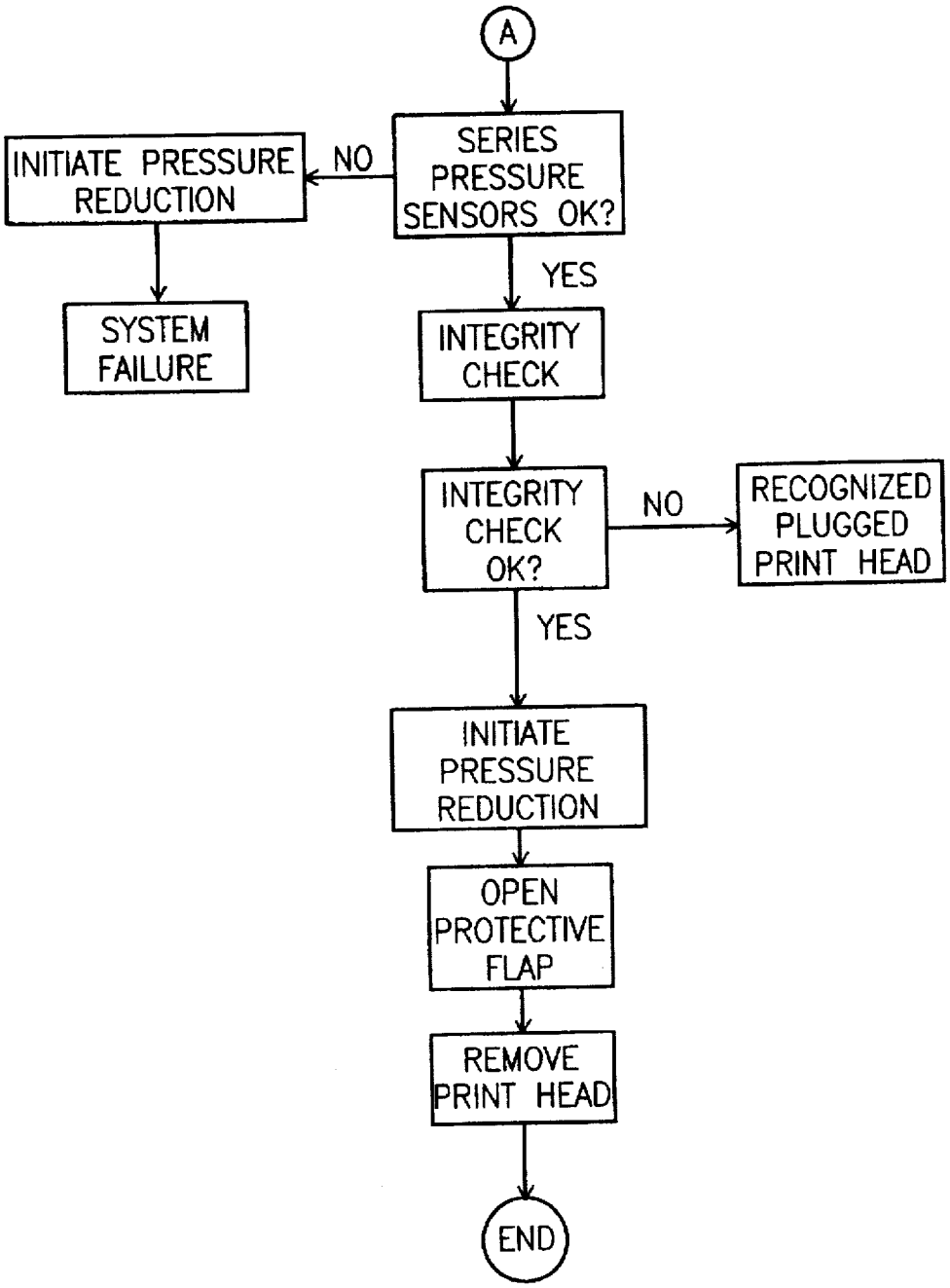

In the FIGS. 5*a* and 5*b* the simplified fluid flow diagram for the automatic control of the refill process is shown.

Through the actuation the start key (key E1) the program is started, which first senses whether the above-discussed start conditions are satisfied. As far as a system fault is detected, this is displayed (display element A9).

So long as the startup pre-conditions are satisfied, the closure flap 79 can be opened. Thereupon the print head 100 is introduced and the closure flap 79 is again capable of being closed. Insofar as there is an ink supply in the device and all further safety conditions are satisfied, the refill process can be started.

The refill process is monitored by sensor elements (in particular pressure switches E3, E4, E5, E6, E7), which are interrogated sequentially and the interrogation is cyclically repeatedly. Insofar as a interrupt signal is produced, a pressure reduction in the supply channel (conduit 30) is initiated and a system failure is indicated.

Following the proper running of the refill process this is terminated by means of a switched back seal check. In connection therewith the determined condition is indicated and the pressure in the supply conduit 30 is reduced. Thereafter the protective flap 79 is opened and the print head 100 can be removed. The print head 100 can also be removed in the case that the security check determines that the print head 100 is plugged up. For this an indicator element A8 is provided which indicates this condition via a noticeable blinking signal.

As a further safety aspect a time limitation for the filling process is provided. In the case that the predetermined time runs out before the fill process is brought to a successful completion, a system failure is indicated and the refill process is interrupted.

From the preceding, it can be seen that by means of the concept according to the present invention it is made possible to provide for the fully automatic operation of a refill station, which provides a high measure of operating comfort and safety.

Legend

10 Control electronics
11 Circuit board
12 LED
14 Locking pin
15 Locking magnet
19 Electricity supply unit
20 Ink tank
22 Housing
30 Conduit
31 Conduit
32 Conduit
33 Conduit
34 Conduit
40 Pump
45 Pump motor
50 Conduit
60 Receptacle container
70 Housing lower section
71 Housing upper section
75 Holder (mounting frame)
78 Safety flap
79 Protective flap
80 Filling support
81 Overflow support
90 Hose distributor
91 Canula
92 Hose distributor
100 Print head
101 Nozzle plate
102 Ventilation opening
105 Ink supply chamber
A4 Indicator element A5 Indicator element
A6 Indicator element
A7 Indicator element
A8 Indicator element
A9 Indicator element
E1 Key
E2 Key
E3 Sensor element
E4 Sensor element
E5 Sensor element
E6 Sensor element
E7 Sensor element
E8 Sensor element
E9 Sensor element
E10 Sensor element
E11 Sensor element

What is claimed is:

1. A device for the refilling of a print head of an ink jet printer outside of the ink jet printer according to a refill process, wherein said print head includes a nozzle plate having an emission opening, an ink supply chamber which is in fluid communication with said emission opening of said nozzle plate, and a ventilation opening, the device comprising:

a holder into which said print head can be inserted and positioned such that said nozzle plate is directed essentially upwards;

an ink tank for supplying refill ink to the print head;

a first conduit means for establishing a releasable sealingly engaged conduit for flow of ink between the ink tank and the ventilation opening;

a pump for transporting refill ink out of said ink tank to said ink supply chamber of said printer head, said pump capable of reversing direction of transport;

a receptacle container for capturing ink emitted from the nozzle plate, a second conduit means for establishing a releasable sealingly engaged conduit between the nozzle plate and the receptacle container; and control electronics for the fully automatic control of the refill process, said control electronics including means for monitoring for the desired fill level while ink is conveyed to the ink supply chamber and means for reversing the direction of flow of the pump upon detection of the achievement of the desired fill level for reduction of the supply pressure to the ink supply chamber.

2. Device as in claim 1, wherein said control electronics control the pump to continue the pumping action in the reverse direction until a predetermined underpressurization is established in the print head ink supply chamber.

3. Device according to claim 1, comprising at least one signal emitter in the conduit between the nozzle plate and the receptacle container, wherein said signal emitter gives a signal as soon as ink enters the conduit, and wherein said signal causes termination of the transporting of the ink out of the ink tank into the ink supply chamber.

4. Device according to claim 1, comprising at least one signal emitter in the conduit between the ink tank and the ventilation opening, said signal emitter being located in the segment between the pump and the ventilation opening, wherein said signal emitter emits a signal upon detection of a stepwise increase in pressure as a result of the ink conveyed to the ink supply chamber substantially filling the same and being in proximity to the nozzle plate to induce a throttle effect, whereupon via the control electronics the supply of the ink from the ink tank is terminated.

5. Device according to claim 1, wherein said ink tank is constructed of a flexible material.

6. Device according to claim 5, wherein said flexible material forms a bag.

7. Device according to claim 5, wherein said ink tank is integrated into a form-retentive housing.

8. Device according to claim 1, wherein said ink tank is designed to be changed out.

9. Device according to claim 1, wherein said receptacle container is filled at least in part with an absorptive material.

10. Device according to claim 9, wherein said absorptive material is selected from the group consisting of felt, sponge, and fleece.

11. Device according to claim 1, wherein said receptacle container is designed to be changed out.

12. Device according to claim 1, wherein said ink tank and said receptacle container are integrated into a common housing.

13. Device according to claim 1, wherein said conduits are flexible hoses.

14. Device according to claim 13, wherein said hoses are made of a material selected from the group consisting of silicon, polytetrafluoroethylene, and polyethylene.

15. Device according claim 13, wherein said pump is a hose pump.

16. Device according to claim 1, wherein said nozzle plate and said ventilation opening are coupled to the respective conduits via a coupling piece, and wherein said coupling piece is a one-piece coupling piece.

17. Device according to claim 1, wherein said print head while mounted in the holder for refilling is tilted with respect to vertical at an angle in the vicinity of between 0° and 80° and with the nozzle plate facing upwards.

18. Device according to claim 1, wherein the holder is pivotable in such a manner that the print head can be introduced into the holder from above with a downwards facing nozzle plate and the holder with the inserted print head can be subsequently be pivoted so that the nozzle plate faces upwards.

19. Device according to claim 1, wherein the tilt orientation of the holder can be arrested in a variety of predetermined tilt positions.

20. Device according to claim 1, wherein adaptors for conforming the holder to the configurations of various print heads can be seated in the holder.

21. Device according to claim 1, wherein the holder is itself constructed as an adaptor for conforming to the configuration of a print head.

22. Device according to claim 1, wherein said holder includes a housing with a lockable cover dome.

23. Device according to claim 22, wherein said lockable cover dome is coupled with said control electronics such that when the lockable cover dome is not completely closed the refilling process can not be started.

24. Device according to claim 22, wherein said lockable cover dome is coupled with said control electronics in such a manner, that upon opening of the lockable cover dome the pump is immediately reversed, so that the supply pressure is reduced.

25. Device according to claim 24, wherein upon the reversing of said pump a predetermined amount of underpressurization in the ink supply chamber is established.

26. Device according to claim 1, wherein said holder includes a housing with a lockable safety flap.

27. Device according to claim 26, wherein said lockable safety flap is coupled with the control electronics such that when the lockable safety flap is not completely closed the refilling process can not be started.

28. Device according to claim 26, wherein said lockable safety flap is coupled with said control electronics in such a manner, that upon opening of the safety flap the pump is immediately reversed and the supply pressure is reduced.

29. Device according to claim 28, wherein upon the reversing of said pump a predetermined amount of underpressurization in the ink supply chamber is established.

* * * * *